US005270519A

United States Patent [19]

Higgins

[11] Patent Number: 5,270,519

[45] Date of Patent: Dec. 14, 1993

[54] RADIANT HEATER HAVING MULTIPLE HEATING ZONES

[75] Inventor: George A. Higgins, Hagley, United Kingdom

[73] Assignee: Ceramaspeed Limited, United Kingdom

[21] Appl. No.: 889

[22] Filed: Jan. 5, 1993

[30] Foreign Application Priority Data

Jan. 10, 1992 [GB] United Kingdom ..... 9200532

[51] Int. Cl.[5] ..... H05B 1/00; H05B 3/68

[52] U.S. Cl. ..... 219/464; 219/446

[58] Field of Search ..... 219/446, 464, 465, 467, 219/468, 452, 449, 485, 508

[56] References Cited

U.S. PATENT DOCUMENTS

| | | | |
|---|---|---|---|
| 1,436,657 | 11/1922 | Ingersoll | 219/446 |
| 2,291,857 | 8/1942 | Woodman | 219/485 |
| 2,419,083 | 4/1947 | Myers | 219/446 |
| 4,538,051 | 8/1985 | Schreder et al. | 219/446 |

FOREIGN PATENT DOCUMENTS

| | | | |
|---|---|---|---|
| 0164900 | 12/1985 | European Pat. Off. . | |
| 1097586 | 1/1961 | Fed. Rep. of Germany | 219/446 |
| 193572 | 2/1938 | Switzerland | 219/446 |
| 559337 | 2/1975 | Switzerland | 219/446 |
| 816962 | 7/1959 | United Kingdom | 219/446 |
| 2069300 | 8/1981 | United Kingdom . | |
| 2080660 | 3/1982 | United Kingdom . | |
| 2148678 | 5/1985 | United Kingdom . | |
| 2193617 | 2/1988 | United Kingdom . | |
| 2044057 | 10/1990 | United Kingdom . | |

*Primary Examiner*—Bruce A. Reynolds
*Assistant Examiner*—John A. Jeffery
*Attorney, Agent, or Firm*—Ira S. Dorman

[57] ABSTRACT

In a radiant heater having multiple heating zones there is provided a first heating zone incorporating at least one heating element and a second heating zone incorporating at least first and second heating elements. A thermal cut-out device includes a temperature sensor which passes through at least the first heating zone and which is responsive solely to heat emitted in the first heating zone. A manually operable switch permits switching between first and second heating states. In the first heating state, the at least one heating element in the first heating zone is energised alone, while in the second heating state the at least one heating element in the first heating zone is electrically connected in series with the second heating element of the second heating zone, the at least one heating element and the second heating element being energised in parallel with the first heating element of the second heating zone.

15 Claims, 4 Drawing Sheets

RADIANT HEATER HAVING MULTIPLE HEATING ZONES

The present invention relates to a radiant heater having multiple heating zones which may be used, for example, in a cooking appliance having a glass ceramic cooking plate.

BACKGROUND TO THE INVENTION

Radiant heaters having multiple heating zones are known for example from United Kingdom Patent Specification No. 2 069 300 and European Patent Specification No. 0 103 741. European Patent Specification No. 0 103 741 describes a heater having inner and outer concentric heating zones, the inner heating zone containing one heating element and the outer heating zone containing two heating elements. A temperature sensor of a thermal cut-out device extends over both the inner and outer heating zones and is sensitive to heat emitted in both zones. The thermal cut-out device has two switches operating at upper and lower cut-out temperatures in order to protect the glass ceramic cooking surface against overheating.

When the inner heating element is used alone, for example to heat a small cooking utensil, the inner heating element is operated at full power. In this condition, the inner heating element is connected to the thermal cut-out device by way of its switch operable at the lower cut-out temperature. When both the inner and outer heating zones are to be used together, for example to heat a large cooking utensil, one of the heating elements in the outer zone is electrically connected in series with the heating element in the inner zone, and the two heating elements in series are connected in parallel with the other heating element in the outer zone. In this condition, the heating elements are connected to the thermal cut-out device by way of its switch operable at the upper cut-out temperature. The effect of this is to reduce the specific heating surface loading in the inner zone as compared with the outer zone.

This arrangement has the disadvantage that two switches on the thermal cut-out device are required to control the operation of the heating elements, one of the switches being a changeover switch rather than a simple make-and-break switch. This precludes the possibility of using the second switch on the thermal cut-out device as a signal switch, for example to warn the user of the cooking appliance that the glass ceramic cooking surface is at an elevated temperature and may be too hot to touch.

OBJECT OF THE INVENTION

It is an object of the present invention to provide a radiant heater having multiple heating zones in which it is possible to modify the specific heating surface loading of one of the heating zones in a manner which only uses a single switch of the thermal cut-out device.

SUMMARY OF THE INVENTION

According to the present invention there is provided a radiant heater having multiple heating zones comprising:

a first heating zone provided with at least one heating element;

a second heating zone provided with at least first and second heating elements;

a thermal cut-out device including a temperature sensor passing through at least the first heating zone and responsive solely to heat emitted in the first heating zone; and switch means for switching between first and second heating states, the arrangement being such that in the first heating state the at least one heating element in the first heating zone is energised alone and that in the second heating state the at least one heating element in the first heating zone is electrically connected in series with the second heating element of the second heating zone, the at least one heating element and the second heating element being energised in parallel with the first heating element of the second heating zone.

The heating element in the first heating zone may be a coil of bare resistance wire, an infra-red lamp, or a coil of bare resistance wire electrically connected in series with an infra-red lamp.

The first heating element of the second heating zone may be a coil of bare resistance wire, an infra-red lamp, or a coil of bare resistance wire electrically connected in series with an infra-red lamp.

The second heating element of the second heating zone may be a coil of bare resistance wire.

The temperature sensor may pass through the second heating zone in a manner which renders the sensor substantially unresponsive to heat emitted in the second heating zone. For example, the temperature sensor may comprise a differential expansion member, the differential expansion of the sensor being substantially eliminated in that region of the sensor passing through the second heating zone. Alternatively, that region of the temperature sensor passing through the second heating zone may be isolated from heat emitted in the second heating zone by means of a block of thermal insulating material at least partly surrounding the sensor. As a further alternative, that region of the temperature sensor passing through the second heating zone may be at least partly surrounded by a thermally conducting element arranged to conduct heat externally of the heater. According to another alternative, that region of the temperature sensor passing through the second heating zone may be isolated from heat emitted in the second heating zone and exposed to heat emitted in the first heating zone.

The first and second heating zones may be separated by a wall of thermal insulating material.

The first heating zone may be circular and the second heating zone may be annular, the second heating zone surrounding the first heating zone.

For a better understanding of the present invention and to show more clearly how it may be carried into effect reference will now be made, by way of example, to the accompanying drawings in which:

DESCRIPTION OF PREFERRED EMBODIMENTS

Figure 1:
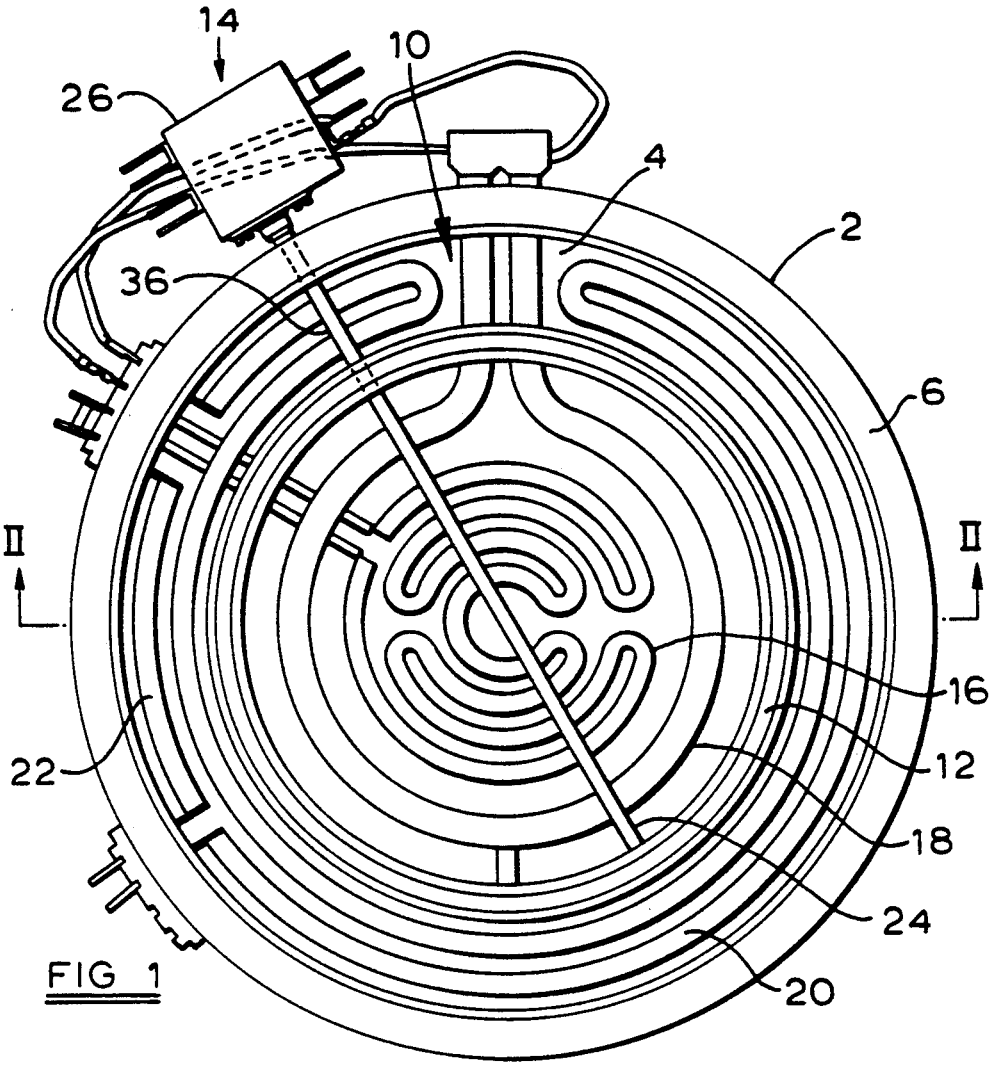
FIG. 1 is a plan view of one embodiment of a radiant heater according to the present invention.
Figure 2:
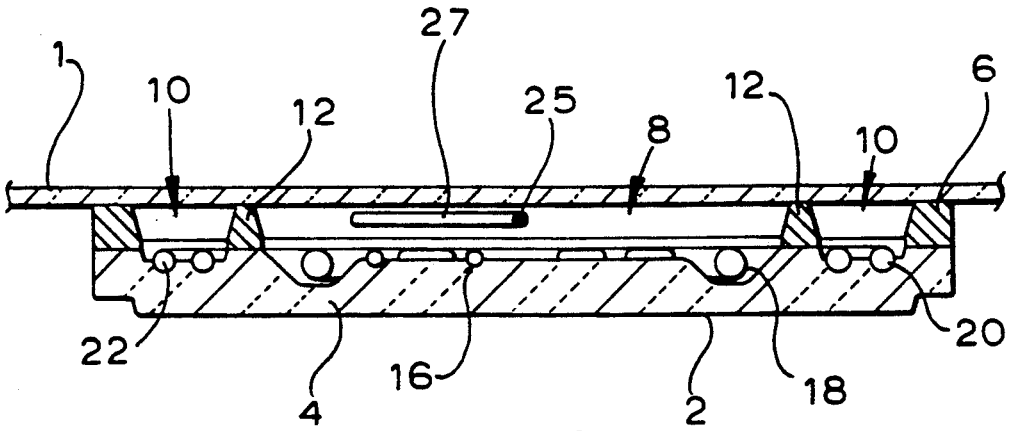
FIG. 2 is a cross-sectional view taken along the line II—II in FIG. 1.

The radiant heater shown in FIGS. I and 2 is arranged beneath a cooking surface 1, for example of glass ceramic material, and comprises a metal dish 2 containing a base layer 4 of electrical and thermal insulating material. Against the side of the dish 2 is located a peripheral wall 6 of thermal insulating material. The area within the peripheral wall 6 is divided into a first or inner, generally circular heating zone 8 and a second or outer, annular heating zone 10 by means of a circular wall 12 of thermal insulating material. Extending over the inner heating zone 8 and over at least a part of the outer heating zone 10 is a thermal cut-out device 14 for protecting the cooking surface against excessive temperatures. The thermal cut-out device will be explained in more detail hereinafter.

Within the inner heating zone 8 are arranged two heating elements 16 and 18. Element 16 is in the form of a coil of bare resistance wire located in a groove formed in the base layer 4 and arranged within an infra-red lamp 18 of generally circular configuration. The lamp 18 is positioned within, but generally not in contact With, a recess formed in the base layer 4. Where the lamp 18 passes across the outer heating zone 10, the envelope of the lamp 18 is coated with a substantially opaque material in order to confine any visible light emitted by the lamp 18 to the inner heating zone 8.

In the outer heating zone 10 are arranged two heating elements 20 and 22. Element 20 is in the form of a coil of bare resistance wire located in a groove formed in the base layer 4 and is generally in the form of two concentric arcs, the inner arc extending substantially around the circumference of the outer heating zone and the outer arc extending substantially around 300 degrees of the outer heating zone. Element 22 is also in the form of a coil of bare resistance wire located in a groove formed in the base layer 4 and is generally in the form of an arc extending substantially around 60 degrees of the outer heating zone in that portion not occupied by the heating element 20.

The thermal cut-out device 14 comprises a differential expansion probe-type temperature sensor 24 comprising a rod 25 of material having a high coefficient of thermal expansion, such as an iron-chrome alloy, arranged within a tube 27 of material having a low coefficient of thermal expansion, such as quartz, and a switch assembly 26 operable by the sensor 24. The sensor is configured in such a way that it is sensitive substantially only to heat emitted by the heating elements 16 and 18 in the inner heating zone 8 and is isolated from any heat emitted by the heating elements 20 and 22 in the outer heating zone 10.

Figure 3A:
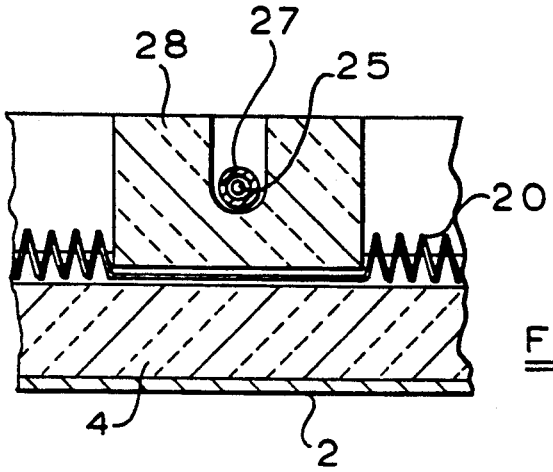
FIG. 3*a* is an elevational view of another embodiment of a part of the radiant heater shown in FIGS. 1 and 2.
Figure 3B:
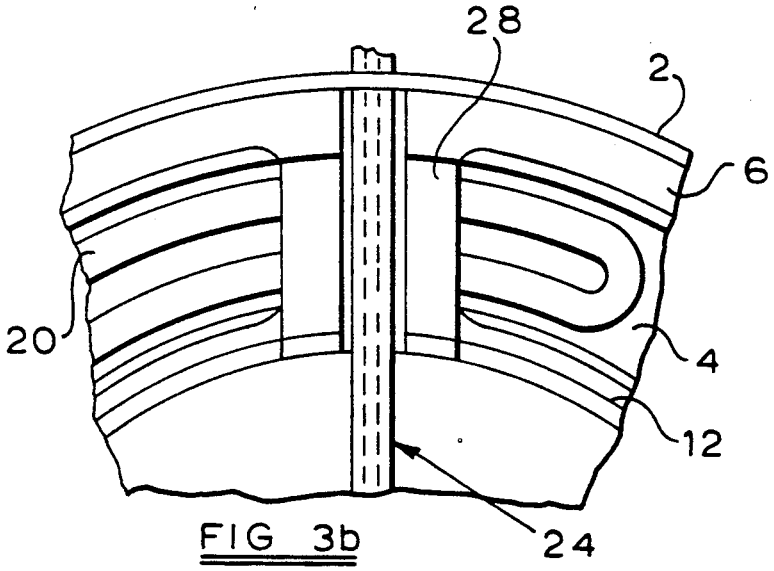
FIG. 3*b* is a plan view corresponding to FIG. 3*a;*
Figure 4:
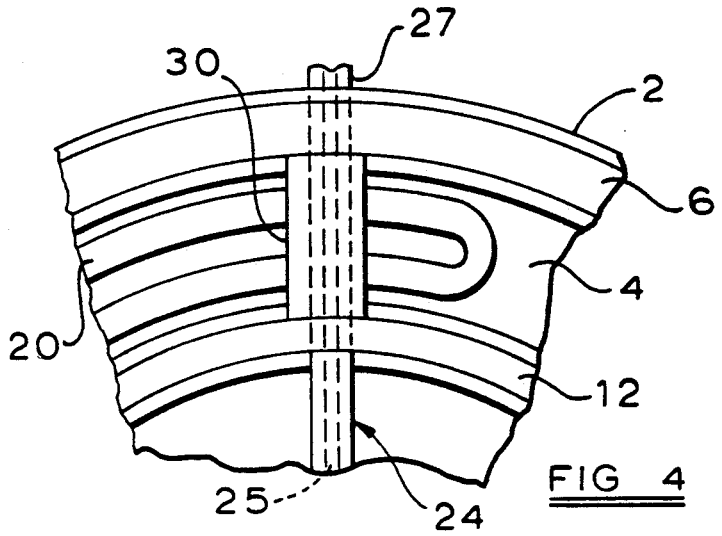
FIG. 4 is a plan view of a further embodiment of part of the radiant heater shown in FIGS. 1 and 2.
Figure 5:
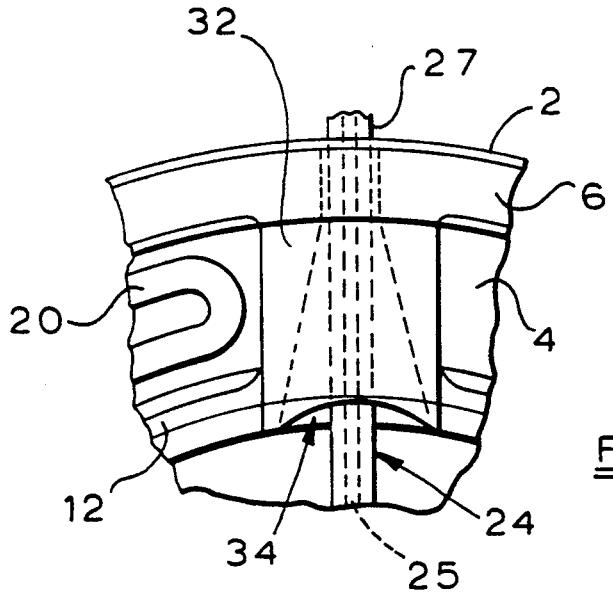
FIG. 5 is a plan view of a yet another embodiment of part of the radiant heater shown in FIGS. 1 and 2.

Isolation of the temperature sensor 24 can be achieved in a number of ways. As shown in FIG. 1, the effective length of the temperature sensor 24 can be designed to terminate substantially at the boundary between the inner and outer heating zones, for example by substituting for the low expansion tube 27 in the outer heating zone a high expansion tube 36, for example made of the same material as that of the high expansion rod 25. As shown in FIGS. 3a and 3b, the temperature sensor can be isolated by enclosing that part of the sensor passing through the outer heating zone 10 in a block 28 of thermal insulating material. As shown in FIG. 4, the temperature sensor can be isolated by enclosing that part of the sensor passing through the outer heating zone 10 in a heat conducting material, such as a copper tube 30, such that the copper tube acts as a heat sink and heat absorbed is conducted outside the radiant heater. As shown in FIG. 5, the temperature sensor can be isolated by extending the thermal influence of heat emitted in the inner heating zone to that part of the sensor passing through the outer heating zone 10, for example by providing a block 32 of thermal insulating material having a tapering tunnel 34 formed therein and communicating with the inner heating zone. It will be noted, however, that some minor alteration to the configuration of the heating element 20 may be required.

Because the temperature sensor 24 is isolated from heat emitted by the heating elements 20 and 22 in the outer heating zone 10, it is necessary only to provide a single set of switch contacts in the switch assembly 26. The use of a thermal cut-out device 14 having only a single set of switch contacts in the switch assembly 26 results in a device which is more economical to manufacture compared with a thermal cut-out device such as that described in European Patent Specification No. 0 103 741 which requires a switch assembly with an additional changeover switch for switching power to the heating elements. Where a second set of make-and-break contacts is available, as in FIG. 1, these can have a lower power capacity and can be employed to switch at a considerably lower temperature, for example 60° C., to give an indication to the user that the cooking surface I may be too hot to touch.

Figure 6:
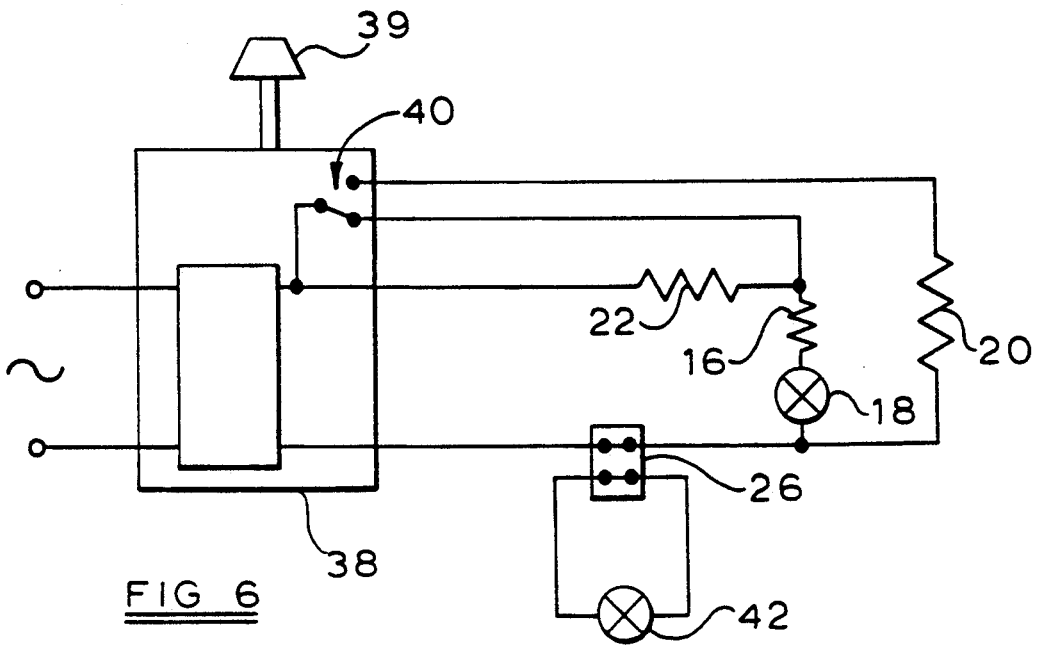
FIG. 6 is a schematic circuit diagram illustrating one circuit for controlling the radiant heater of FIGS. 1 and 2.

In use, the radiant heater is incorporated in a circuit such as that shown in FIG. 6. FIG. 6 shows that electrical energy is supplied to the radiant heater by way of an energy regulator 38 having a manually adjustable control knob 39 which determines the mark-to-space ratio of the switched output from the regulator. The energy regulator also incorporates a manually operable changeover switch 40 for switching between a first heating state in which only the heating elements 16 and 18 in the inner heating zone 8 are energised, for example for heating a relatively small cooking utensil, and a second heating state in which all the heating elements 16, 18, 20 and 22 are energised, for example for heating a relatively large cooking utensil.

Figure 7:
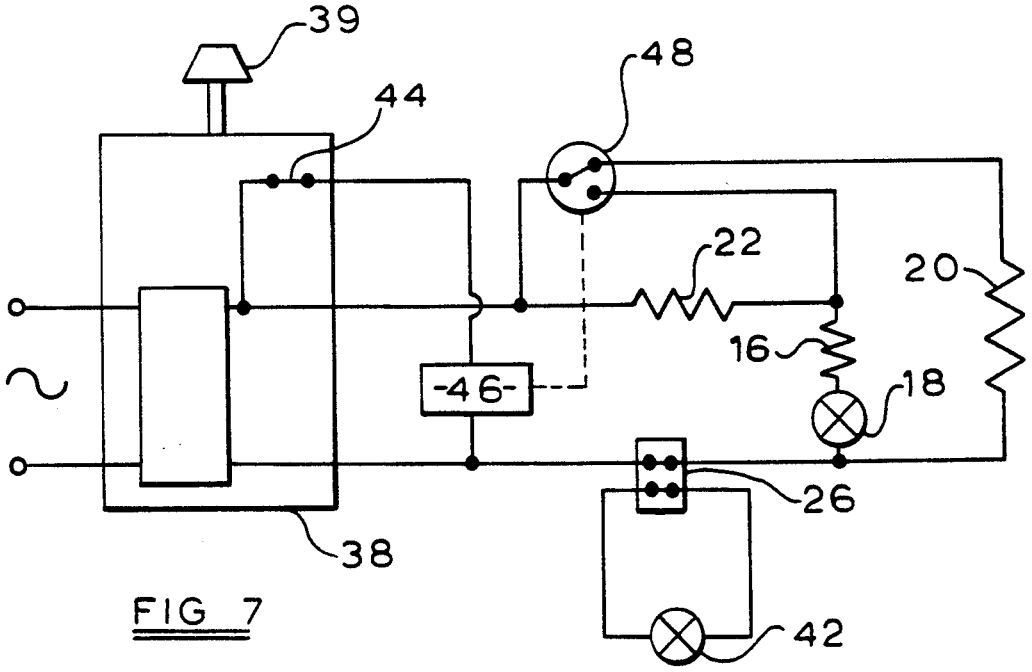
FIG. 7 is a schematic circuit diagram illustrating another circuit controlling the radiant heater of FIGS. 1 and 2.

In the first heating state as illustrated, in which only the heating elements 16 and 18 in the inner heating zone 8 are energised, electrical power passes through the switch 40 to the heating elements 16 and 18 which are electrically connected in series. The heating elements 16 and 18 are electrically connected in series because the lamp 18 has a very low electrical resistance at low temperatures and thus draws a very high starting current. It is often desirable to limit the starting current by incorporating a conventional heating coil in series with the lamp. For an inner heating zone 8 having a diameter of some 145 mm the combined heating power of the heating elements 16 and 18 is typically 1200 watts giving a specific surface loading of some 0.073 watts/mm$^2$. The temperature in the inner heating zone 8 is monitored by the temperature sensor 24 of the thermal cut-out device 14. When the temperature detected exceeds a first predetermined temperature the first set of contacts in the snap switch assembly 26 is actuated to energize a warning light 42, and when the temperature detected exceeds a second predetermined temperature the second set of contacts in the snap switch assembly 26 is actuated to cut off power to both the heating elements 16 and 18. In the second heating state, in which the heating elements 20 and 22 in the outer heating zone 10 are energised in addition to the heating elements 16 and 18 in the inner heating zone, electrical power passes through the switch 40 to the heating element 20 and electrical power passes directly to heating elements 22, 16 and 18 which are electrically connected in series. The heating element 20 is connected in parallel with the series connected elements 22, 16 and 18. Heating element 22 is designed to generate typically 117 watts of power in the outer heating zone 10 and to reduce the power generated in the inner heating zone 8 by the heating elements 16 and 18 to typically 1000 watts, giving a specific surface loading of some 0.061 watts/mm$^2$. Heating element 20 is designed to generate typically 1083 watts in the outer heating zone 10, making the total heat generated in the outer heating zone 10 some 1200 watts. For a radiant heater having a diameter of some 210 mm, and an internal wall 5 mm thick where it is in contact with the underside of the glass ceramic cooking surface, the specific surface loading in the outer heating zone 10 is some 0.076 watts/mm$^2$, that is about 25 per cent above the specific surface loading for the inner heating zone 8. As with the first heating state, the temperature in the inner heating zone 8 is monitored by the temperature sensor 24 of the thermal cut-out device 14. When the temperature detected exceeds a first predetermined temperature the first set of contacts in the snap switch assembly 26 is actuated to energize a warning light 42, and when the temperature detected exceeds a second predetermined temperature the second set of contacts in the snap switch assembly 26 is actuated to cut off power to all the heating elements 16, 18, 20 and 22. However, it will be noted that in the second heating state the heat generated in the inner heating zone is reduced from 1200 watts to 1000 watts. This has the effect of modifying the specific surface loading of the inner heating zone and permits the heat distribution in the inner and outer heating zones to be optimized in each of the first and second heating states. Use of the radiant heater in the circuit according to FIG. 7 is similar to that of FIG. 6, except that the switch 44 in the energy regulator is a simple make-and-break switch rather than a more complex changeover switch. In order to use the radiant heater with the switch 44 in the second heating state as illustrated, electrical power from the switch 44 is connected across a relay coil 46 and relay contacts 48 are employed as a substitute for the switch 40.

Numerous modifications are possible to the radiant heater described above. For example, the heater need not have a concentric circular configuration. Other configurations include an arrangement where the inner heating zone and the outer heating zone are not concentric or an arrangement where a circular zone is provided for the first heating zone and a second heating zone is provided in the form of an additional zone on one or opposite sides of the circular zone so as to form a generally oval or rectangular heater.

Although the invention has been described with two heating elements 16 and 18 in the first heating zone this is not necessary and the first heating zone may alternatively be provided with a single coil of bare resistance wire or a single infra-red lamp. Moreover, the invention has been described with a single heating element 20 generating the major part of the power in the second heating zone, but this may alternatively comprise an infra-red lamp or a coil of bare resistance wire in series with an infra-red lamp.

The major benefit of the radiant heater according to the present invention is that the specific surface loading of the first heating zone is capable of being modified with a thermal cut-out device having a snap switch assembly with only a single set of contacts. This permits the heater to give improved performance over existing heaters that employ thermal cut-out devices having a snap switch assembly with only a single set of contacts. The invention also permits the heater either to be manufactured more economically than known radiant heaters that are able to modify the specific surface loading of one of the heating zones or to be more versatile in providing the well known facility for indicating to the user that the cooking surface may be too hot to touch.

I claim:

1. A radiant heater having multiple heating zones comprising:

a first heating zone provided with at least one heating element;

a second heating zone provided with at least first and second heating elements;

a thermal cut-out device including a temperature sensor passing through at least the first heating zone and responsive solely to heat emitted in the first heating zone; and switch means for switching between first and second heating states, the arrangement being such that in the first heating state the at least one heating element in the first heating zone is energised alone and that in the second heating state the at least one heating element in the first heating zone is electrically connected in series with the second heating element of the second heating zone, the at least one heating element and the second heating element being energised in parallel with the first heating element of the second heating zone.

2. A radiant heater according to claim I, wherein the first heating zone is provided with a heating element in the form of a coil of bare resistance wire.

3. A radiant heater according to claim 1, wherein the first heating zone is provided with a heating element in the form of an infra-red lamp.

4. A radiant heater according to claim 1, wherein the first heating zone is provided with a heating element in the form of a coil of bare resistance wire electrically connected in series with an infra-red lamp.

5. A radiant heater according to claim I, wherein the first heating element of the second heating zone comprises a coil of bare resistance wire.

6. A radiant heater according to claim 1, wherein the first heating element of the second heating zone comprises an infra-red lamp.

7. A radiant heater according to claim 1, wherein the first heating element of the second heating zone comprises a coil of bare resistance wire electrically connected in series with an infra-red lamp.

8. A radiant heater according to claim 1, wherein the second heating element of the second heating zone comprises a coil of bare resistance wire.

9. A radiant heater according to claim 1, wherein the temperature sensor passes through the second heating zone in a manner which renders the sensor substantially unresponsive to heat emitted in the second heating zone.

10. A radiant heater according to claim 9, wherein the temperature sensor comprises a differential expansion member, the differential expansion of the sensor being substantially eliminated in that region of the sensor passing through the second heating zone.

11. A radiant heater according to claim 9, wherein that region of the temperature sensor passing through the second heating zone is isolated from heat emitted in the second heating zone by means of a block of thermal insulating material at least partly surrounding the sensor.

12. A radiant heater according to claim 9, wherein that region of the temperature sensor passing through the second heating zone is at least partly surrounded by a thermally conducting element arranged to conduct heat externally of the heater.

13. A radiant heater according to claim 9, wherein that region of the temperature sensor passing through the second heating zone is isolated from heat emitted in the second heating zone and exposed to heat emitted in the first heating zone.

14. A radiant heater according to claim 1, wherein the first and second heating zones are separated by a wall of thermal insulating material.

15. A radiant heater according to claim 1, wherein the first heating zone is circular and the second heating zone is annular, the second heating zone surrounding the first heating zone.

* * * * *